US012584380B2

(12) United States Patent
Arsoski et al.

(10) Patent No.: US 12,584,380 B2
(45) Date of Patent: Mar. 24, 2026

(54) COMBINATION LANDING AND FLOAT COLLAR

(71) Applicant: DOWNHOLE PRODUCTS LIMITED, Portlethen (GB)

(72) Inventors: Darko Arsoski, Angus (GB); Douglas Brian Farley, Missouri City, TX (US)

(73) Assignee: DOWNHOLE PRODUCTS LIMITED

( * ) Notice: Subject to any disclaimer, the term of this patent is extended or adjusted under 35 U.S.C. 154(b) by 0 days.

(21) Appl. No.: 19/179,048

(22) Filed: Apr. 15, 2025

(65) Prior Publication Data

US 2025/0369312 A1 Dec. 4, 2025

Related U.S. Application Data

(60) Provisional application No. 63/655,641, filed on Jun. 4, 2024.

(51) Int. Cl.
*E21B 41/00* (2006.01)
*E21B 33/12* (2006.01)
*E21B 34/10* (2006.01)

(52) U.S. Cl.
CPC ..... *E21B 41/00* (2013.01); *E21B 33/1208* (2013.01); *E21B 34/10* (2013.01); *E21B 2200/08* (2020.05)

(58) Field of Classification Search
CPC ..... E21B 41/00; E21B 33/1208; E21B 34/10; E21B 2200/08
See application file for complete search history.

(56) References Cited

U.S. PATENT DOCUMENTS 2,153,034 A * 4/1939 Baker ..... E21B 21/10 166/194
2,436,525 A 2/1948 O'Donnell
4,286,659 A * 9/1981 Bolding, Jr. ..... E21B 21/10 210/451
4,286,664 A * 9/1981 Bolding, Jr. ..... E21B 21/10 137/903
4,442,894 A * 4/1984 Callihan ..... E21B 21/10 166/386
4,872,510 A 10/1989 Lehr
5,234,052 A * 8/1993 Coone ..... E21B 21/10 166/155
5,246,069 A * 9/1993 Glaser ..... E21B 33/167 166/155
5,390,736 A 2/1995 Budde
(Continued)

OTHER PUBLICATIONS

Extended European Search Report dated Sep. 1, 2025 for EP application No. 25175641.7.

*Primary Examiner* — Steven A Macdonald

(57) ABSTRACT

A combination landing and float collar for use in a wellbore includes: a float valve; a receiver including a plug seat and a ball seat; a tubular housing having a coupling formed at a longitudinal end thereof for assembly as part of a downhole tubular; a first sheath bonding the receiver to an inner surface of the housing within a flow bore thereof; a second sheath bonding the float valve to the inner surface of the housing within the flow bore thereof; a chamber formed in the housing between the first and second sheaths and operable to keep a ball released from the ball seat; and a baffle disposed in the chamber and operable to prevent passage of the ball therethrough.

19 Claims, 7 Drawing Sheets

(56) References Cited

U.S. PATENT DOCUMENTS

| | | | | |
|---|---|---|---|---|
| 5,553,667 | A | 9/1996 | Budde | |
| 5,680,902 | A | 10/1997 | Giroux | |
| 5,762,139 | A | 6/1998 | Sullaway | |
| 6,056,053 | A | 5/2000 | Giroux | |
| 6,634,428 | B2 | 10/2003 | Krauss | |
| 7,090,153 | B2 | 8/2006 | King | |
| 7,182,135 | B2 | 2/2007 | Szarka | |
| 7,665,520 | B2 | 2/2010 | Szarka | |
| 8,807,227 | B2 | 8/2014 | Fould | |
| 9,518,452 | B2 | 12/2016 | Turley | |
| 9,719,322 | B2 * | 8/2017 | Goebel | E21B 43/10 |
| 11,391,119 | B2 * | 7/2022 | Parameshwaraiah | E21B 34/12 |
| 11,459,874 | B1 * | 10/2022 | Stair | E21B 17/14 |
| 11,499,393 | B2 | 11/2022 | Bilen | |
| 11,867,019 | B2 * | 1/2024 | Wright | E21B 33/1208 |
| 11,976,533 | B1 * | 5/2024 | Thomas | E21B 33/14 |
| 12,055,013 | B2 | 8/2024 | Ridner | |
| 12,270,274 | B2 * | 4/2025 | Bock | E21B 33/14 |
| 2003/0116320 | A1 * | 6/2003 | Szarka | E21B 34/103 166/291 |
| 2006/0185855 | A1 * | 8/2006 | Jordan | E21B 17/08 166/380 |
| 2011/0192608 | A1 * | 8/2011 | LeJeune | F16K 15/063 166/319 |
| 2011/0290344 | A1 * | 12/2011 | Groesbeck | E21B 34/16 137/430 |
| 2016/0010400 | A1 * | 1/2016 | Goebel | E21B 33/16 166/382 |
| 2016/0312566 | A1 * | 10/2016 | Andrigo | E21B 33/167 |
| 2017/0370186 | A1 | 12/2017 | Stair | |
| 2023/0069930 | A1 | 3/2023 | Arsoski | |
| 2024/0125200 | A1 | 4/2024 | Al-Ramadhan | |
| 2024/0229598 | A1 * | 7/2024 | Evans | E21B 34/101 |
| 2024/0410244 | A1 | 12/2024 | Arboneaux | |
| 2025/0043638 | A1 | 2/2025 | Arsoski | |

* cited by examiner

COMBINATION LANDING AND FLOAT COLLAR

BACKGROUND OF THE DISCLOSURE

Field of the Disclosure

The present disclosure generally relates to a combination landing and float collar.

Description of the Related Art

U.S. Pat. No. 2,436,525 discloses liner setting tools, and more particularly an arrangement for permanently affixing a liner to a casing in an oil well and for cementing the liner in place. A liner is lowered into a well on tubing or drill pipe together with an arrangement whereby the liner may be hung on the casing in the well, after which the tubing may be manipulated in such a way as to direct cement around the outside of the liner, means being provided for holding the cement slurry in place until it is set, while the drill pipe or tubing together with the parts attached thereto is removed from the well. After the cement slurry has been squeezed around the outside of the liner, the excess is washed out of the interior.

U.S. Pat. No. 4,872,510 discloses a subterranean well casing float tool including a tubular metal housing which is securable to a well casing conduit. Valving means are emplaced within the housing, with substantially all of the components of the valving means, save a biasing means, are thermosetting. The valving means has a thermosetting frame and valve head and valve seat means relative to the frame. A biasing member, such as a compressed spring is used for urging the valve head toward the valve seat to a closed position. A compartment including the valve head is provided for enclosure around the biasing means when the valve head is moved fully away from the valve seat to protect the spring from erosive turbulent fluid flow when the valve head is in the open position relative to the seat. The valving means is directly secured to the housing by means of thread members having profiled shear surfaces such that the shear area of the valving means is substantially greater than that of the metal housing.

U.S. Pat. No. 5,390,736 discloses an anti-rotation device for use in a well tool, for example a top plug or a bottom plug, has a tapered male member having a corrugated outer surface which can enter a corresponding recess in another well tool to inhibit relative rotation therebetween.

U.S. Pat. No. 5,553,667 discloses a new cementing system including a plug container with a flow diverter for diverting a portion of flowing fluid away from plugs in the plug container; a plug set system with internal sleeves or dart receivers with shearable parts for shearing to selectively release plugs—all in certain embodiments made of non-metal material and/or plastic; and a swivel equalizer with internal valving to isolate a plug set (or any other item) from torque and to relieve pressure below the swivel equalizer.

U.S. Pat. No. 5,680,902 discloses a fill valve includes a tubular housing which accommodates a valve member which is biased toward a closed position by a light spring. The valve member includes a head and a tubular portion which is provided with two large windows. When the fill valve is open fluid flows freely through the tubular portion of the fill valve and out of the windows.

U.S. Pat. No. 5,762,139 discloses an improved subsurface release cementing plug apparatus for use in a string of pipe during the cementing of the pipe in a well bore. The apparatus includes a hollow cementing plug seat member adapted to be connected in the string of pipe near the bottom thereof and a cementing plug assembly releasably connectable to a circulation tool or casing running tool in the top of the string of pipe. The cementing plug assembly includes a top cementing plug having an external annular seating surface formed thereon for sealingly engaging a top internal annular seating surface of the cementing plug seat member, and a bottom cementing plug releasably connected to the top cementing plug having an external annular seating surface formed thereon for engaging a bottom internal annular seating surface of the cementing plug seat member.

U.S. Pat. No. 6,056,053 discloses a plug container with a flow diverter for diverting a portion of flowing fluid away from plugs in the plug container; a plug set system with internal sleeves or dart receivers with shearable parts for shearing to selectively release plugs—all in certain embodiments made of non-metal material and/or plastic; a swivel equalizer with internal valving to isolate a plug set (or any other item) from torque and to relieve pressure below the swivel equalizer; and unique burst tube systems for selectively controlling fluid flow and plug system operation. In one aspect a plug nose is tapered to correspond to a taper of a landing ring so that wedge-locking of the nose and ring effects desired non-rotation of the plug during drilling. In one aspect plug fin bending is facilitated by reducing plug body thickness so that an alternate fluid flow path is provided for cementing. In one aspect a new float valve system is provided with a top baffle that prevents debris etc. from shutting off fluid flow to a float valve.

U.S. Pat. No. 6,634,428 discloses a removable ball seat assembly is disclosed. It features a solid ball seat backed up by segmented dogs pinned to each other and mounted under the ball seat. Upon actuating a downhole tool with fluid pressure applied to a ball on the seat, the pressure is increased and the ball and seat move at a regulated rate. The dogs reach a recess and the ball moves through the seat. Subsequent, larger balls can pass through the seat, with the dogs in the recess, at much smaller pressure drops than the original ball.

U.S. Pat. No. 7,090,153 discloses a flow conditioning system for fluid jetting tools includes a housing having a plurality of jet nozzle openings and a fluid straightener disposed within the housing. The fluid straightener is defined by one or more vanes, and the vanes form a plurality of flow channels within the housing. Each flow channel is associated with at least one jet nozzle opening.

U.S. Pat. No. 7,182,135 discloses a method and plug for separating fluids in subterranean wells. The plug enters a passage at an interface of successively introduced fluids. The plug comprises an outer body and a detachable inner mandrel attached to the outer body. An assembly including a plurality of plugs may also be used, in which case the plurality of plugs releasably attach to each other. A bypass baffle may be located within a casing coupling above the float valve, or may be located such that solid bottom rests atop the surface of the upper float valve. Among other benefits, the inclusion of a bypass baffle within a casing string may reduce potential turbulence in the fluid region above the float valve, thereby reducing any potential for erosion of the float valve which may exist.

U.S. Pat. No. 7,665,520 discloses methods and devices useful in stage cementing operations. One example of an apparatus may comprise a catcher tube assembly and a deformable device. One example of a method is a method of stage cementing a casing string comprising: positioning a catcher tube on top of a float collar; pumping a first fluid through the casing string; placing a first deformable device in the casing string; and pumping a second fluid through the casing string, thereby causing the first deformable device to translate downward in the casing string and into the catcher tube.

U.S. Pat. No. 8,807,227 discloses an apparatus for pressure-testing a tubular body may be installed in the tubular-body interior. The apparatus comprises an activation-device seat, one or more bypass ports, a J-slot with an indexing pin and a spring. When an activation device, for example a ball, lands in the activation-device seat, fluid communication through the tubular body is blocked, allowing pressurization. During pressurization, the activation-device seat moves downward, causing the spring to compress and the indexing pin in the J-slot to move to the bottom position. Upon depressurization after the test, the activation-device seat moves upward, causing to spring to decompress and the indexing pin the J-slot to move to the top position. Upward movement of the activation-device seat unblocks the bypass ports, thereby reestablishing fluid communication through the tubular body. The tubular body may be drillpipe, casing or coiled tubing that is installed in the borehole of a subterranean well.

U.S. Pat. No. 9,518,452 discloses a setting tool for hanging a tubular string includes: a tubular mandrel having an actuation port formed through a wall thereof; a debris barrier for engaging an upper end of the tubular string; and a piston having an upper face in fluid communication with the actuation port. The setting tool further includes: an actuator sleeve extending along the mandrel and connected to the piston; a latch releasably connecting the debris barrier to the actuator sleeve and for releasably connecting the debris barrier to the tubular string; a packoff connected to the mandrel below the piston and operable to seal against an inner surface of the tubular string, thereby forming a buffer chamber between the debris barrier and the packoff; and a passage. The passage: is in fluid communication with a lower face of the piston, is formed in a wall of and along the mandrel, and bypasses the packoff.

U.S. Pat. No. 11,499,393 discloses a sub having an anti-rotation feature for a resource exploration and recovery system includes a tubular having an outer surface and an inner surface defining a flow bore. A sleeve is slideably disposed in the flow bore between a first position and a second position. The sleeve includes an inner surface portion having a taper. A dart including an end portion is disposed in the sleeve. The dart is configured to shift the sleeve between the first position and the second position when exposed to a selected pressure in the flowbore. The end portion includes a tapered section. The tapered section mating with the taper formed in the inner surface to rotatably lock the plug to the inner surface of the sleeve.

US 2017/0370186 discloses a differential fill valve assembly for application in float collars or shoes in a well casing can provide locking mechanisms to limit premature movement of an activating sleeve while facilitating desired advancement of the activating sleeve. The valve assembly comprises a backpressure flapper valve and an activating sleeve slidably disposed within a housing. The activating sleeve initially maintains the flapper valve in an open position while the activating sleeve is maintained in its position by upper and/or lower lock rings on either side of a shoulder of the activating sleeve. A tripping ball is dropped to seat in the activating sleeve. Pressure applied on the ball moves the activating sleeve downward, releasing the backpressure flapper valve, after which the tripping ball exits the bottom of the assembly. The lower lock ring maintains the activating sleeve in its lower position.

US 2023/0069930 discloses a flow-actuated valve for use in a wellbore includes: a body; a poppet movable relative to the body between an open position and a closed position; a spring biasing the poppet toward the closed position; and a shifter having a drogue and a detent engaged with a detent profile of the poppet and a locking receptacle of the body when in an auto-fill mode, thereby keeping the poppet in a partially open position. The valve is operable to shift to a float mode in response to a first flow rate moving the poppet toward the open position to disengage the detent from the locking receptacle and a second flow rate imparting a drag force on the drogue sufficient to disengage the detent from the detent profile. The second flow rate is different than the first flow rate.

US 2024/0125200 discloses a cementing string assembly for cementing a liner in a wellbore including a drill pipe, a liner hanger running tool attached to the drill pipe, a liner releasably secured to the liner hanger running tool, an upper wiper plug disposed within the liner and releasably secured to the liner hanger running tool or to the liner, and a lower wiper plug disposed within the liner and releasably secured to the liner downhole of the upper wiper plug. The lower wiper plug is detached from the upper wiper plug. The lower wiper plug is releasably secured to an inner surface of the liner by a wiper plug hanging collar and is releasable from the liner independent of the upper wiper plug and without exerting forces on the upper wiper plug. The cementing string assembly prevent premature and unintentional release of the upper wiper plug while releasing the lower wiper plug.

US 2024/0410244 discloses a debris catcher assembly including a debris filter assembly having a selectively operable valve, such as a rupture disk, to allow a secondary flow path should the debris filter assembly become clogged with debris.

US 2025/0043638 discloses a float collar for use in a wellbore includes: a float valve; a tubular housing having a coupling formed at a longitudinal end thereof for assembly as part of a downhole tubular; a sheath bonding the float valve to an inner surface of the housing within a flow bore thereof, the sheath having a bore formed therein; and a ball deflector seated against a top of the sheath and having: an upper grate and a lower anchor engaged with an inner surface of the sheath adjacent the bore. The float valve, the sheath, and the ball deflector are made from materials drillable by a polycrystalline diamond compact (PDC) drill bit.

WO 2022/098448 discloses a float tool used for controlling flow in tubing. The float tool includes a housing, at least one valve, and at least one inset. The housing is configured to install on the tubing and has a longitudinal bore therethrough. The at least one valve is disposed in the longitudinal bore. The at least one valve is configured to allow the flow in a downbore direction through the longitudinal bore and is configured to prevent flow in a upbore direction through the longitudinal bore. The at least one inset is disposed in the longitudinal bore and is disposed downbore of the at least one valve. The at least one inset defines an orifice therethrough. The orifice has one or more vanes angled relative to the longitudinal bore. The one or more vanes are configured to produce turbulence in the flow in the downbore direction through the longitudinal bore.

SUMMARY OF THE DISCLOSURE

The present disclosure generally relates to a combination landing and float collar. In one embodiment, a combination landing and float collar for use in a wellbore includes: a float valve; a receiver including a plug seat and a ball seat; a tubular housing having a coupling formed at a longitudinal end thereof for assembly as part of a downhole tubular; a first sheath bonding the receiver to an inner surface of the housing within a flow bore thereof; a second sheath bonding the float valve to the inner surface of the housing within the flow bore thereof; a chamber formed in the housing between the first and second sheaths and operable to keep a ball released from the ball seat; and a baffle disposed in the chamber and operable to prevent passage of the ball therethrough.

In another embodiment, a ball receptacle for use in a wellbore includes: a tubular body; and an annular seat: disposed within the body, connected to the body, made of one-piece construction, having an upper portion with a non-cylindrical inner surface for receiving a ball, and having a blind annular recess extending from an end surface thereof such that an inner fragment of the seat is operable to fracture from an outer portion of the seat in response to a threshold pressure exerted on the ball seated therein, thereby releasing the ball.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
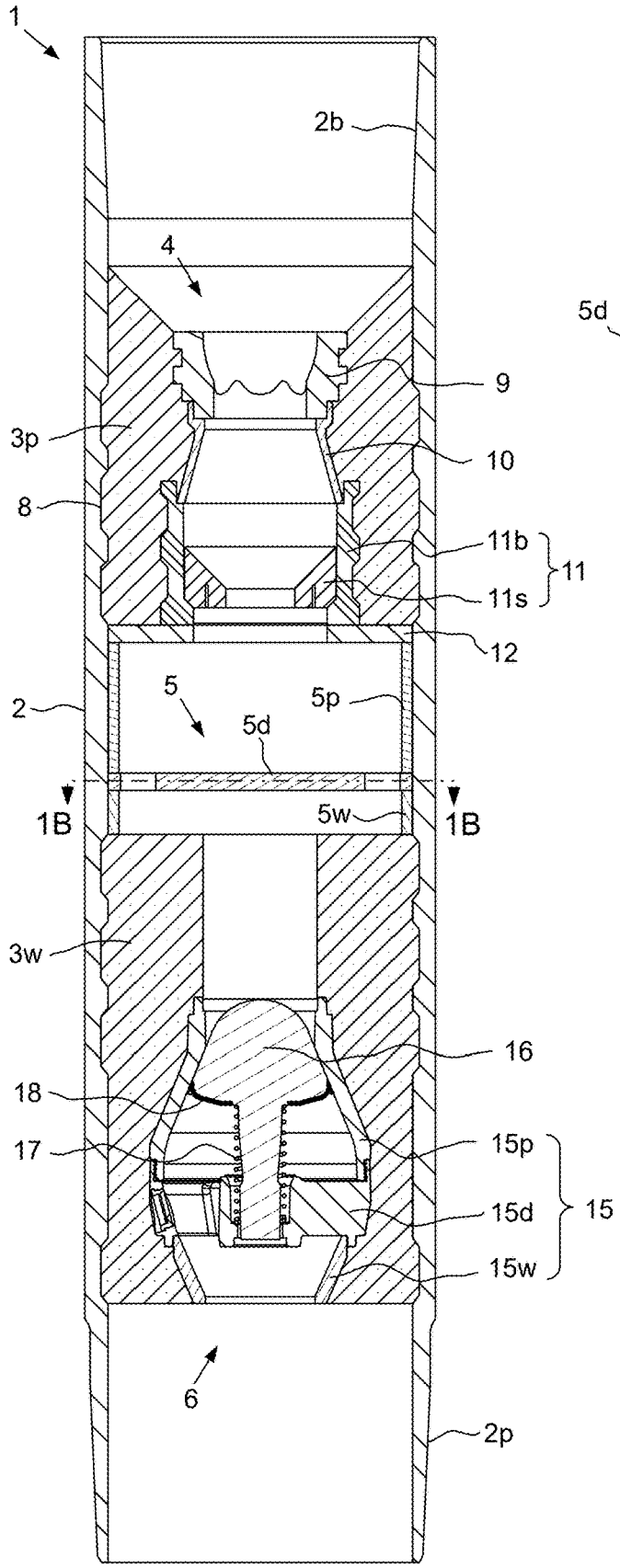
FIG. 1A illustrates a combination landing and float collar, according to one embodiment of the present disclosure.
Figure 1B:
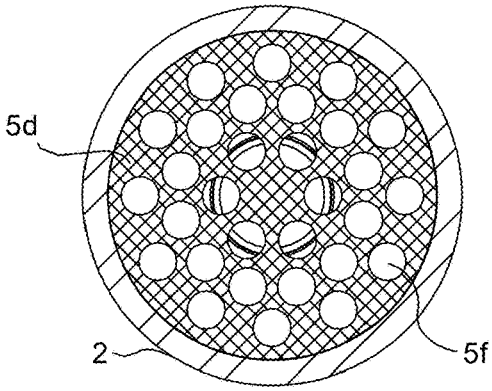
FIG. 1B is a cross section taken along line 1B-1B of FIG. 1A.

FIG. 1A illustrates a combination landing and float collar 1, according to one embodiment of the present disclosure. FIG. 1B is a cross section taken along line 1B-1B of FIG. 1A. The combination landing and float collar 1 may include a housing 2, one or more sheaths, such as an upper sheath 3*p* and a lower sheath 3*w*, a receiver 4, a baffle 5, and a float valve 6. The housing 2 may be tubular and may have a coupling formed at each longitudinal end thereof, such as a threaded pin 2*p* or box 2*b*, for assembly with joints 7*j* (FIG. 3B) of a downhole tubular, such as a liner string 7. A length of the housing 2 may be less than or equal to ten feet (three meters), six feet (one point eight meters), or three feet (zero point nine meter).

Alternatively, the combination landing and float collar 1 may be a combination landing collar and float shoe instead by having a guide shoe instead of the lower pin 2*p*.

The combination landing and float collar 1 may be assembled with and at a lower portion of the liner string 7. The housing 2 may have an array of grooves 8 for each sheath 3*p, w* formed in and along an inner surface thereof to facilitate bonding with the respective sheath. The housing 2 may be made from a metal or alloy, such as steel. The sheaths 3*p, w*, the receiver 4, the baffle 5, and the float valve 6 may be made from materials drillable by a polycrystalline diamond compact (PDC) drill bit, such as a nonferrous material. By nonferrous, it is meant that the material contains no more than a trace amount of iron.

The sheaths 3*p, w* may each be made from cement, such as Portland cement or Portland cement concrete. Each sheath 3*p,w* may torsionally and longitudinally bond the respective receiver 4 and float valve 6 to the housing 2 within a flow bore thereof. Each sheath 3*p, w* may also seal the respective interface between the receiver 4 and the housing 2 and between the float valve 6 and the housing to prevent fluid bypass thereof. Each sheath 3*p, w* may surround the respective receiver 4 and float valve 6.

The receiver 4 may include a plug seat 9, a flow tube 10, a ball receptacle 11, and a mold base 12. The ball receptacle 11 may include an outer body 11*b* and an inner seat 11*s*. The flow tube 10 may be made from a composite material, such as a polymer composite, such as a fiber reinforced polymer. A lower end of the flow tube 10 may be connected to an upper end of the outer body 11*b* by a lap joint and secured, such as by adhesive or threads. An upper end of the flow tube 10 may be connected to a lower end of the plug seat 9 by a lap joint and secured, such as by adhesive or threads. The flow tube 10 may also have an anti-rotation profile, such as a plurality of flats (not shown), formed in an outer surface thereof to facilitate boding with the upper sheath 3*p* in a torsional manner. The flow tube 10 may have an upper portion and a lower portion. The upper portion of the flow tube 10 may have a constant inner diameter. The lower portion of the flow tube 10 may have an inner diameter increasing from an upper end thereof to an interface with the outer body 11*b*.

Figure 4A:
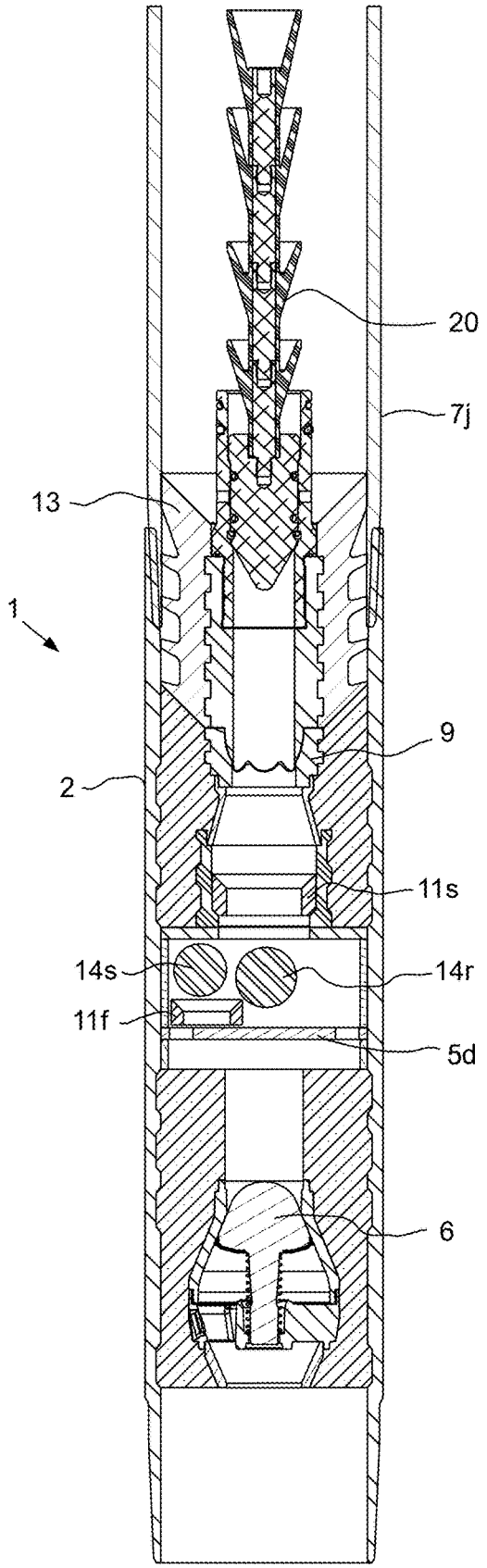
FIG. 4A illustrates further operation of the combination landing and float collar.

The plug seat 9 may be tubular and be made from any of the flow tube materials, discussed above. The plug seat 9 may have one or more grooves formed in an outer surface thereof to facilitate boding with the upper sheath 3*p* in a torsional manner. A top of the plug seat 9 may be flat and a top of the upper sheath 3*p* may have a tapered inner surface for forming a landing profile for a wiper plug 13 (FIG. 4A).

A taper angle of the upper sheath 3*p* may correspond with a taper angle of the wiper plug 13 such that tapered fit is formed there-between. The tapered fit may be self-holding or self-releasing. A socket may be formed in an inner surface of the plug seat 9 and may extend from a top thereof. The socket may have an anti-rotation profile formed therein, for forming a torsional connection with the wiper plug 13.

The outer body 11*b* of the ball receptacle 11 may be tubular and be made from any of the flow tube materials, discussed above. The outer body 11*b* may have one or more grooves formed in an outer surface thereof to facilitate boding with the upper sheath 3*p* in a torsional manner. The outer body 11*b* may have an upper portion with an enlarged inner diameter, a lower portion with a reduced inner diameter, and a shoulder formed between the upper and lower portions. The outer body 11*b* may be of one-piece construction.

The seat 11*s* of the ball receptacle 11 may be annular, have a flow bore formed therethrough, and have an outer diameter slightly greater than the enlarged inner diameter of the outer body 11*b*, thereby forming a press fit there-between. The seat 11*s* may be made from a composite material, such as a fiber reinforced polymer, such as having a thermoplastic or thermoset matrix reinforced by ceramic or carbon fibers, such as glass fibers. The seat 11*s* may be of one-piece construction. The seat 11*s* may be disposed within the outer body 11*b* and may have a shoulder formed at an interface between the outer surface and bottom thereof for engaging the shoulder of the outer body. The shoulders of the ball receptacle 11 may be tapered. A taper angle of the seat shoulder may correspond with a taper angle of the outer body shoulder such that tapered fit is formed there-between. The tapered fit may be self-holding or self-releasing. The press fit and the tapered fit between the seat and body shoulders may longitudinally and torsionally connecting seat 11*s* and the outer body 11*b*. The press fit and/or the tapered fit between the seat and body shoulders may also seal an interface between the seat 11*s* and the outer body 11*b*. The seat 11*s* may have an upper portion with a non-cylindrical, such as a frusto-conical, inner surface, for receiving a first ball, such as setting ball 14*s* (FIG. 2A), and a cylindrical lower portion. The upper portion of the seat 11*s* may have an inner diameter decreasing from an upper end thereof to an interface with the lower portion thereof. The lower portion of the seat 11*s* may have a constant inner diameter.

Alternatively, the seat 11*s* may be bonded to the body 11*b* using an adhesive instead of being press fit.

The seat 11*s* may be operable to receive and hold the setting ball 14*s*, keep the setting ball until a threshold pressure has been reached, and then release the setting ball. The seat 11*s* may be pre-weakened by an annular recess such that an inner fragment 11*f* (FIG. 3A) of the seat fractures, such as shears, from a force exerted thereon by the threshold pressure exerted on the setting ball 14*s*, thereby releasing the setting ball from the seat. Failure and ejection of the inner fragment 11*f* of the seat 11*s* may also increase a minimum diameter thereof such that a second larger ball, such as releasing ball 14*r* (FIG. 3A), may pass therethrough unobstructed.

The mold base 12 may be annular and may be secured to the housing 2, such as by adhesive or interference fit. The mold base 12 may be used for positioning of the receiver 4 within the housing 2 and formation of the upper sheath 3*p*. A chamber may be formed in the housing 2 between the upper 3*p* and lower 3*w* sheaths (neglecting the mold base 12).

The baffle 5 may include an upper spacer 5*p*, a lower spacer 5*w*, and a perforated disc 5*d* disposed between the spacers. Each spacer 5*p,w* may be tubular and have marginal thickness such that an inner diameter thereof is only slightly less than an outer diameter thereof. The baffle 5 may be disposed in the housing chamber and may be trapped therein between the upper and lower sheaths 3*p,w*. Each spacer 5*p,w* and the perforated disc 5*d* may have an outer diameter slightly less than inner diameter of the housing 2, thereby forming a clearance or transition fit there-between. The upper spacer 5*p* may have a length greater than the lower spacer, such as more than twice the length thereof. The perforated disc 5*d* may divide the housing chamber into an upper portion and a lower portion. The upper portion of the housing chamber may receive and keep the setting 14*s* and releasing 14*r* balls and the length of the upper spacer 5*p* may be sufficient such that the upper portion of the chamber has sufficient size for this function. The upper portion of the chamber may also receive and keep the inner fragment 11*f* of the seat 11*s*.

The perforated disc 5*d* may have one or more (three shown) arrays of flow ports 5*f* distributed there-about. Each array of flow ports 5*f* may be concentric with the perforated disc 5*d*. Each flow port 5*f* may be formed through the perforated disc 5*d* and have a diameter less than a diameter of the smaller setting ball 14*s* to prevent passage of the setting ball therethrough.

The float valve 6 may be located in a lower portion of the lower sheath 3*w* such that one or more lower end ports of the float valve are exposed to the flow bore of the housing 2. The float valve 6 may include a body 15, a valve member, such as a poppet 16 (a.k.a. plunger), and a biasing member, such as compression spring 17. The body 15 may be made from a polymer, such as a thermoplastic, thermoset, or copolymer. The body 15 may include an upper section 15*p*, a mid-section 15*d*, and a lower section 15*w*. The upper 15*p* and mid 15*d* sections may be connected together by a threaded joint. The mid 15*d* and lower 15*w* sections may be connected together by a lap joint and secured, such as by adhesive or threads. The poppet 16 may have an upper head portion and a lower stem portion.

Alternatively, an autofill float valve may be used instead of the float valve 6. Alternatively, the combination landing and float collar 1 may include a second float valve for redundancy.

The upper body section 15*p* may be frusto-conical and have a valve chamber formed therein for receiving the poppet head. An outer surface of the upper body section 15*p* may have recesses formed therein to facilitate bonding with the lower sheath 3*w* in a torsional manner. An upper end port of the float valve 6 may be formed adjacent the top of the upper body section 15*p* and may be in fluid communication with the valve chamber and a bore of the lower sheath 3*w*. The valve chamber may extend from the upper end port of the float valve 6 along an inner surface of the upper body section 15*p* and through to a lower end thereof. The valve chamber may diverge from the upper end port of the float valve 6 to a lower end of the upper body section 15*p* except for a straight portion at the interface with the mid body section 15*d*.

The mid body section 15*d* may have a plurality of portions, such as an outer rim, an inner hub, and one or more ribs connecting the rim and the hub. Ports of the float valve 6 may be formed between the ribs of the mid body section 15*d* and may be in fluid communication with the valve chamber and the lower body section 15*w*. An outer surface of the mid body section 15*d* may have recesses formed therein adjacent to a bottom thereof to facilitate bonding with the lower sheath 3*w* in a longitudinal and torsional manner. The hub of the mid body section 15*d* may have a passage formed therethrough for receiving the poppet stem. A spring chamber may be formed in an upper portion of the hub of the mid body section 15*d* adjacent to the passage for receiving the spring 17. A spring shoulder may be formed at a bottom of the spring chamber of the mid body section 15*d*.

The poppet 16 may be made from any of the materials of the body 15, discussed above. The poppet head may be mushroom-shaped and may carry a valve seal 18 on a lower portion of an outer surface thereof. The valve seal 18 may be made from an elastomer or elastomeric copolymer and may be mounted to a lower portion of the poppet head, such as by being molded thereon. The poppet 16 may be longitudinally movable relative to the body 15 between an open position (FIG. 2A) and a closed position (shown). The poppet head may have a stop shoulder and a spring shoulder formed at an interface with the poppet stem. In the open position, the stop shoulder of the poppet head may engage a top of the hub of the mid body section 15*d*.

The spring 17 may have an upper end bearing against the spring shoulder of the poppet head and a lower end bearing against the spring shoulder of the hub of the mid body section 15*d*, thereby biasing the poppet 16 toward the closed position. The spring 17 may be made from a non-ferrous metal or alloy. The poppet stem may extend through the hub passage of the mid body section 15*d*. A portion of the hub passage may serve as a guide for the poppet stem and a clearance fit, such as a sliding fit or close running fit, may be formed between an outer surface of the poppet stem and the inner surface of the hub of the mid body section 15*d*.

Alternatively, any of the components of the float valve 6 except the valve seal 18 may be made from any of the materials discussed above for the spring 17.

The lower body section 15*w* may be frusto-conical and have a bore formed therethrough. The lower body section 15*w* may receive the poppet stem when the poppet 16 is in the open position. An outer surface of the lower body section 15*w* may have recesses formed therein to facilitate bonding with the lower sheath 3*w* in a torsional manner. A lower end port of the float valve 6 may be formed adjacent the bottom of the lower body section 15*w* and may be in fluid communication with the bore of the housing 2. The bore of the lower body section 15*w* may converge from the interface with the mid body section 15*d* to a lower end of the lower end of the lower body section 15*w* except for a straight portion at the lower end port of the float valve 6.

Figure 2A:
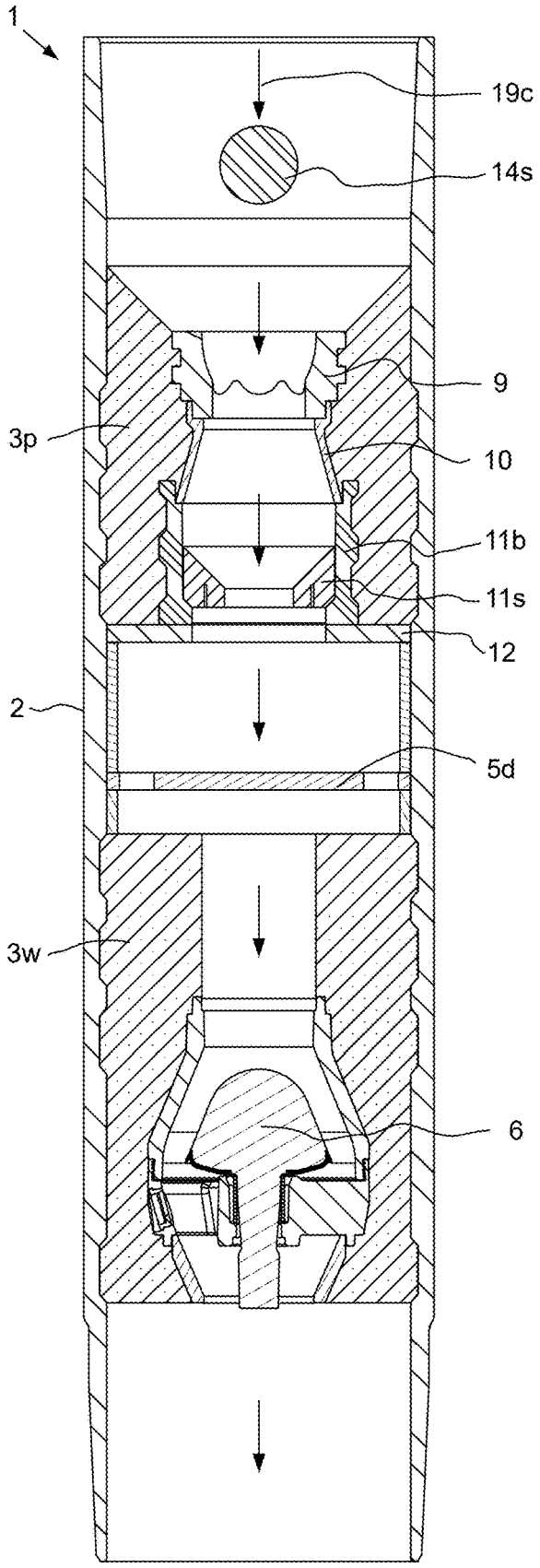
FIGS. 2A and 2B illustrate operation of the combination landing and float collar.
Figure 2B:
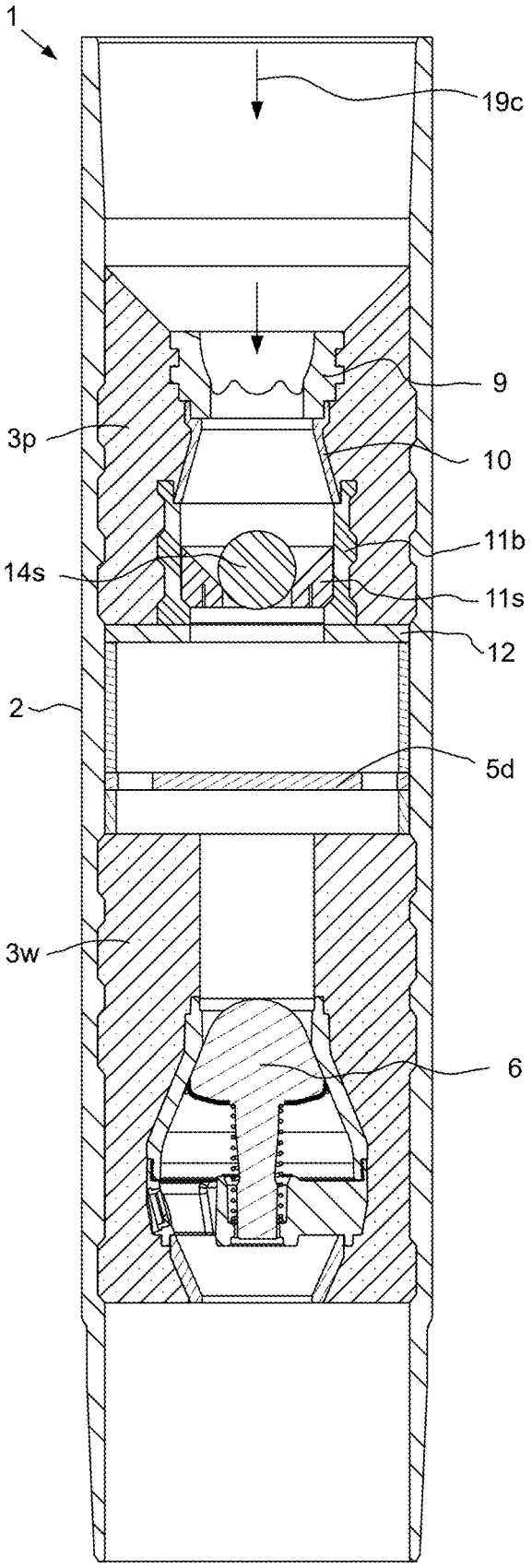

FIGS. 2A and 2B illustrate operation of the combination landing and float collar 1. The liner string 7 may further include a polished bore receptacle (PBR) (not shown), a packer (not shown), a liner hanger (not shown), a liner body (not shown) for carrying the hanger and packer, and a reamer shoe (not shown). The liner body, liner joints, combination landing and float collar 1, and reamer shoe may be interconnected, such as by threaded couplings. The liner string 7 may be deployed into a wellbore (not shown) using a work string (not shown). The work string may include a liner deployment assembly (LDA) and a deployment string, such as joints of drill pipe connected together, such as by threaded couplings. An upper end of the LDA may be connected a lower end of the drill pipe, such as by threaded couplings. The reamer shoe may be rotated by a top drive (not shown) via the work string.

The LDA may include a setting tool, a running tool, a catcher, and a plug release system (including the wiper plug 13). An upper end of the setting tool may be connected to a lower end of the drill pipe, such as by threaded couplings. A lower end of the setting tool may be fastened to an upper end of the running tool. The running tool may also be fastened to the liner body. An upper end of the catcher may be connected to a lower end of the running tool and a lower end of the catcher may be connected to an upper end of the plug release system, such as by threaded couplings.

Once the liner string 7 has been assembled and advanced into the wellbore by the work string to a desired deployment depth, conditioner 19*c* may be pumped down the bores of the work string and liner string and returned to surface via an annulus formed between the two strings and the wellbore. The conditioner 19*c* may be pumped into the downhole tubular via a cementing head (not shown) connected to a top of the work string at a drilling rig at a surface of the earth or the sea. Pumping of the conditioner 19*c* may create a differential pressure across the poppet head, thereby moving the poppet 16 downward to the open position. During circulation of the conditioner 19*c*, the setting ball 14*s* may be launched from the cementing head into the bore of the work string and the conditioner may propel the setting ball down the work string and through the bore of the liner string to the seat 11*s* of the ball receptacle 11. The setting ball 14*s* may land in the seat 11*s* and continued pumping of the conditioner 19*c* may increase pressure on the seated setting ball 14*s* which also pressurizes the bore of the portion of the liner string there-above and the bore of the work string, thereby also operating the setting tool to set the liner hanger against a casing string (not shown) previously installed in the wellbore.

Figure 3A:
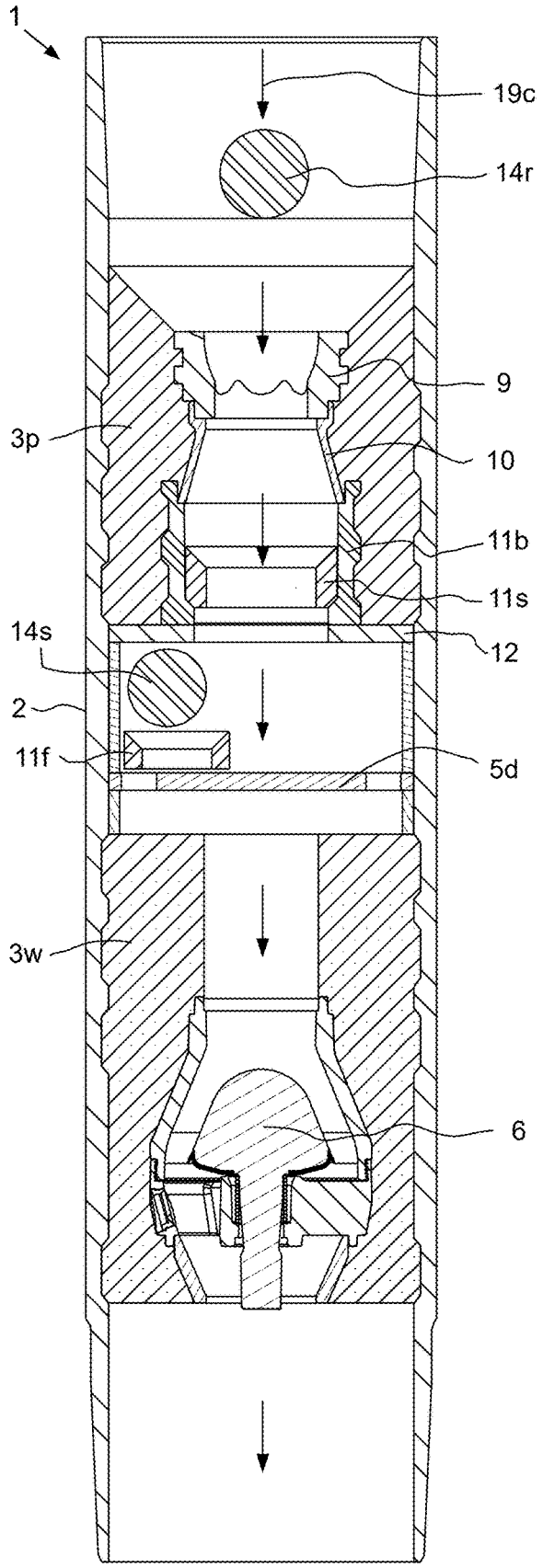
FIGS. 3A and 3B illustrate further operation of the combination landing and float collar.
Figure 3B:
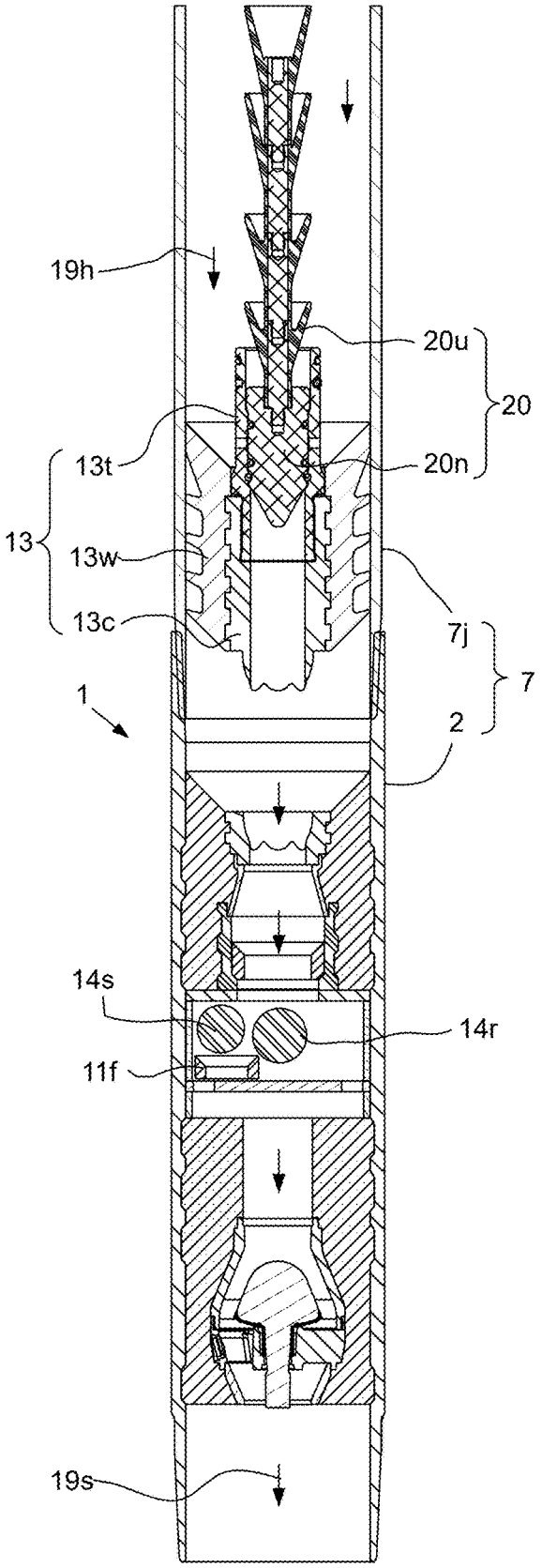

FIGS. 3A and 3B illustrate further operation of the combination landing and float collar 1. Continued pumping of the conditioner 19*c* may further increase pressure on the seated setting ball 14*s* until the threshold pressure has been achieved, thereby fracturing the seat 11*s* of the ball receptacle 11 and releasing the setting ball 14*s* and fragment 11*f*. The conditioner 19*c* may carry the setting ball 14*s* and fragment 11*f* into the chamber adjacent to the baffle disc 5*d*. Setting of the liner hanger may be confirmed, such as by slacking the work string.

The releasing ball 14*r* may then be launched into the bore of the work string and the conditioner 19*c* may propel the releasing ball down the work string to the catcher of the LDA. The releasing ball 14*r* may land in the catcher and continued pumping of the conditioner 19*c* may increase pressure on the seated releasing ball which also pressurizes bore of the work string, thereby also operating the setting tool to release the running tool of the LDA from the liner string. Continued pumping of the conditioner 19*c* may further increase pressure on the seated releasing ball 14*r* until a releasing pressure has been achieved, thereby operating the catcher of the LDA to release the releasing ball. The conditioner 19*c* may carry the releasing ball 14*r* down the bore of the liner string through the seat 11*s* of the ball receptacle 11 and into the chamber adjacent to the baffle disc 5*d*.

The work string and liner string 7 (except for the set hanger) may then be rotated from surface by the top drive and rotation may continue during the cementing operation. Cement slurry 19*s* may be pumped into the bore of the work string. A dart 20 may be launched into the bore of the work string behind the cement slurry. Chaser fluid 19*h* may be pumped into the bore of the work string behind the dart 20. The chaser fluid 19*h* may propel the dart 20 down the bore of the work string until a nose 20*n* of the dart lands in a tail pipe 13*t* of the wiper plug 13.

The wiper plug 13 may include a core 13*c*, a wiper seal 13*w*, and the tail pipe 13*t*. The core 13*c* and the tail pipe 13*t* may be made from any of the flow tube materials, discussed above. The core 13*c* may be cylindrical and have a bore formed there though. An upper portion of the core 13*c* may have threaded coupling, such as a box, formed therein which receives a complementary threaded coupling, such as a pin, formed at a lower end of the tailpipe 13*t*, thereby longitudinally and torsionally connecting the members. The core 13*c* may have one or more grooves formed in an outer surface thereof to facilitate mounting of the respective wiper seal 13*w*. The core 13*c* may have a nose protruding from a lower shoulder thereof and the nose may have an anti-rotation profile formed in a tip thereof for mating with the corresponding profile in the socket of the plug seat 9.

The wiper seal 13*w* may be mounted to the core 13*c* such as by being molded thereon. The wiper seal 13*w* may have a plurality of tabs protruding from an inner surface thereof and each tab may be received in a respective groove of the core 13*c*. The wiper seal 13*w* may include a cylindrical base and a plurality of directional annular fins protruding outward from the base. Each wiper seal 13*w* may be made from an elastomer or elastomeric copolymer. An outer diameter of each fin may correspond to an inner diameter of the liner string 7, such as being slightly greater than the inner diameter. The fins of the wiper seal 13*w* may be oriented to sealingly engage the liner string 7 in response to bore pressure above the wiper seal being greater than bore pressure below the wiper seal. As discussed above, a bottom of the wiper seal 13*w* may be tapered to form a tapered fit with the top of the upper sheath.

The tail pipe 13*t* may have a shoulder formed in an outer surface thereof adjacent to the threaded pin thereof for engagement with a top of the core 13*c*. The shoulder may have a groove formed therein and a seal may be disposed in the groove. An upper portion of the tail pipe 13*t* may have a pair of grooves formed in an outer surface thereof and a seal may be disposed in one of the grooves. The other groove may receive inner portions of one or more respective shearable fasteners for releasably connecting the tail pipe to a mandrel of the plug release system. The tail pipe 13*t* may further have one or more equalization ports formed through a wall thereof at a mid-portion thereof. An upper portion of the tail pipe 13*t* may have an enlarged inner diameter and a lower portion of the tail pipe may have a reduced inner diameter. The mid portion of the tail pipe 13*t* may have an intermediate inner diameter less than the enlarged inner diameter and greater than the reduced inner diameter. The tail pipe 13*t* may have an upper inner shoulder formed between the upper and mid portions thereof, a lower inner shoulder formed between the mid and lower portions thereof, and a groove formed in the inner surface thereof adjacent to the lower shoulder.

The dart 20 may include the nose 20*n* and a plurality of modular units 20*u* (four shown) connected together, such as by threaded couplings. Each modular unit 20*u* may include a core and a wiper seal. Each core may be a rod having threaded couplings formed at each longitudinal end thereof. Each core and the nose 20*n* may be made from any of the flow tube materials, discussed above and each wiper seal may be made from an elastomer or elastomeric copolymer. Each wiper seal may include a cylindrical base and a plurality of directional annular fins protruding outward from the base. An outer diameter of each fin may correspond to an inner diameter of the drill pipe, such as being slightly greater than the inner diameter. The nose 20*n* may have a threaded coupling at an upper portion thereof for connection to the adjacent modular unit 20*u* and a conical lower portion. An upper portion of the nose may have an enlarged diameter, a mid-portion of the nose may have a reduced diameter, and a shoulder may be formed there-between. The nose 20*n* may carry a pair of seals in respective grooves formed in a surface thereof at the mid-portion thereof. The nose 20*n* may also carry a fastener, such as a snap ring, in a groove formed at the interface between the mid portion and the conical lower portion thereof.

The nose 20*n* may land in the tail pipe 20*t* such that the seals of the nose straddle the equalization ports of the tail pipe, thereby closing the equalization ports. The snap ring of the nose 20*n* may engage the groove of the tail pipe, thereby longitudinally connecting the two members. The shoulders of the nose 20*n* may also engage the shoulders of the tail pipe 13*t* for exerting a releasing force thereon. Continued pumping of the chaser fluid 19*h* may increase pressure on the dart 20 until a releasing force generated by the pressure on the dart is sufficient to fracture the shearable fasteners holding the tail pipe is to the mandrel of the plug release system. Continued pumping of the chaser fluid 19*h* may propel the dart 20 and wiper plug 13 down the bore of the liner string 7 until the wiper plug reaches the plug seat 9.

FIG. 4A illustrates further operation of the combination landing and float collar 1. Continued pumping of the chaser fluid 19*h* may align an engage the anti-rotation profile of the nose of the wiper plug 13 with the anti-rotation profile of the socket of the plug seat 9 and engage the tapered bottom of the wiper seal 13*w* with the tapered top of the upper sheath, thereby torsionally connecting the wiper plug 13 to both the upper sheath 3*p* and the plug seat 9. Pumping of the chaser fluid 19*h* and rotation of the work string may be halted and the float valve 6 may close. Closing of the float valve 6 may prevent the cement slurry 19*s* from flowing back into the bore of the liner string 7 above the float collar 1 (aka U-tubing). The work string may be raised to operate a packer actuator of the setting tool and lowered to expand the packer into engagement with the previously installed casing string.

Figure 1C:
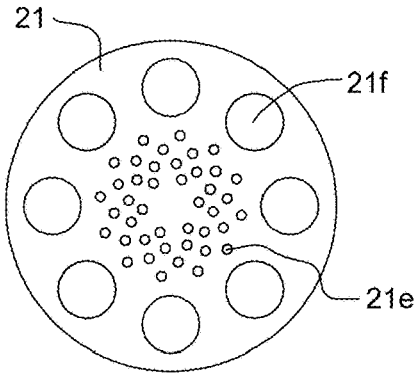
FIG. 1C illustrates an alternative perforated disc for use with the combination landing and float collar, according to another embodiment of the present disclosure.

FIG. 1C illustrates an alternative perforated disc 21 for use with the combination landing and float collar 1, according to another embodiment of the present disclosure. The alternative perforated disc 21 may replace the perforated disc 5*d* in the baffle 5. The alternative perforated disc 21 may be similar to the perforated disc 5*d* except for the arrangement and type of ports formed therethrough. The alternative perforated disc 21 may have one or more (four shown) arrays of equalization ports 21*e* located at an inner portion thereof and an array of flow ports 21*f* located at an outer portion thereof. Each array of ports 21*e,f* may be concentric with the alternative perforated disc 21. Each flow port 21*f* may be formed through the alternative perforated disc 21 and have a diameter less than a diameter of the smaller setting ball 14*s* to prevent passage of the setting ball therethrough. Each equalization port 21*e* may be formed through the alternative perforated disc 21 and have a diameter substantially less than a diameter of the flow ports 21*f*, such as less than one-half, one-third, or one-fourth thereof.

Advantageously, the alternative perforated disc 21 may serve as fluid surge protector for the float valve 6 and/or lower sheath 3*w*. Upon release of the setting ball 14*s* from the seat 11*s*, a fluid surge may be created which if not abated could damage the float valve 6 and/or lower sheath 3*w*. Having the array of flow ports 21*f* located at an outer portion of the alternative perforated disc 21 may create a tortuous flow path through the chamber and into the (central) bore of the lower sheath, thereby dissipating energy from the fluid surge. A second fluid surge may also be created when the releasing ball 14*r* is released from the seat of the ball catcher of the LDA.

Figure 4B:
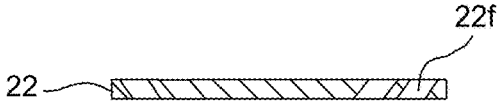
FIGS. 4B and 4C illustrate a second alternative perforated disc for use with the combination landing and float collar, according to another embodiment of the present disclosure.
Figure 4C:
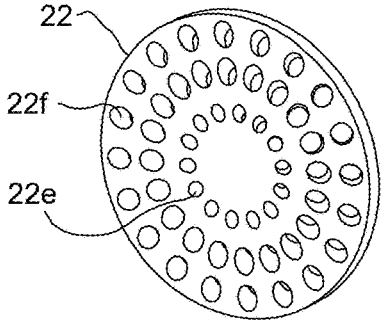

FIGS. 4B and 4C illustrate a second alternative perforated disc 22 for use with the combination landing and float collar 1, according to another embodiment of the present disclosure. The second alternative perforated disc 22 may replace the perforated disc 5*d* in the baffle 5. The second alternative perforated disc 22 may be similar to the perforated disc 5*d* except for the arrangement and type of ports formed therethrough. The second alternative perforated disc 22 may have one or more (one shown) arrays of small flow ports 22*e* located at an inner portion thereof and one or more (two shown) array of large flow ports 22*f* located at an outer portion thereof. Each array of ports 22*e,f* may be concentric with the second alternative perforated disc 22. Each large flow port 22*f* may be formed through the second alternative perforated disc 22 and have a diameter less than a diameter of the smaller setting ball 14*s* to prevent passage of the setting ball therethrough. Each small flow port 22*e* may be formed through the second alternative perforated disc 22 and have a diameter less than a diameter of the large flow ports 22*f*, such as less than two-thirds, one-half, or one-third thereof. Each port 22*e,f* may be angled (relative to an axis parallel to the longitudinal axis of the housing 2), such as tilted inward (shown) toward the bore of the lower sheath 3*w* or outward toward the housing 2, to facilitate the fluid surge protecting effect, discussed above.

Alternatively, the second alternative perforated disc 22 may have straight ports and another (or more) second alternative perforated disc 22 may be added to the baffle having ports radially offset by a specific amount to achieve a similar effect.

Figure 4D:
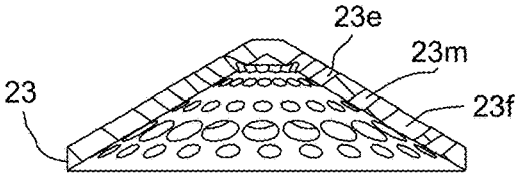
FIGS. 4D and 4E illustrate a perforated cone for use with the combination landing and float collar, according to another embodiment of the present disclosure.
Figure 4E:
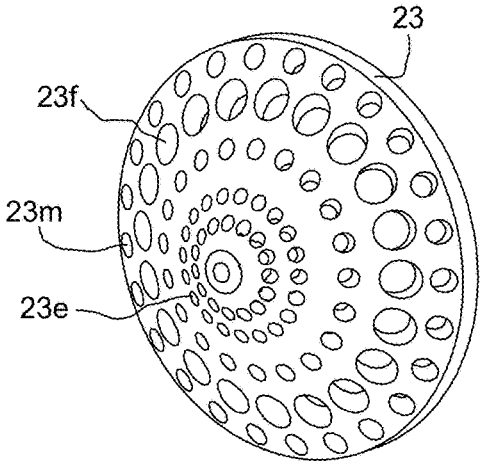

FIGS. 4D and 4E illustrate a perforated cone 23 for use with the combination landing and float collar 1, according to another embodiment of the present disclosure. The perforated cone 23 may replace the perforated disc 5*d* in the baffle 5. The perforated cone 23 may have one or more (two shown) arrays of small flow ports 23*e* located at an inner portion thereof, one or more (two shown) arrays of medium flow ports 23*m* located at an outer portion thereof, and one or more (one shown) array of large flow ports 23*f* located at the outer portion thereof. An apex of the perforated cone 23 may point toward the upper sheath 3*p*. Each large flow port 23*f* may be formed through a wall of the perforated cone 23 and have a diameter less than a diameter of the smaller setting ball 14*s* to prevent passage of the setting ball therethrough. Each small and medium flow port 23*e*,23*m* may be formed through the wall of the perforated cone 23 and have a diameter less than a diameter of the flow ports 23*f*, such as less than three-fourths, two-thirds, one-half, thereof. Each flow port 23*e,f,m* may be angled (relative to an axis parallel to the longitudinal axis of the housing 2), such as tilted inward (shown) toward the bore of the lower sheath 3*w* or outward toward the housing 2, to facilitate the fluid surge protecting effect, discussed above.

In another embodiment (not shown), the housing 2 may be lengthened to accommodate a second perforated disk in the baffle 5. The lower spacer 5*w* would then be an intermediate spacer and the baffle 5 may further include an additional spacer similar to the lower spacer 5*w*. The second perforated disk may be similar to the perforated disk 5*d* and may be disposed between the intermediate spacer and the lower sheath 3*w* and the additional spacer may be disposed between the second perforated disk and the lower sheath. The perforated disk 5*d* may then serve as a sacrificial shield for absorbing impact from the inner fragment 11*f* upon ejection from the inner seat 11*s*. Such impact may damage the perforated disk 5*d* and compromise its capability to keep the balls 14*r,s* and the fragment 11*f* from entering the float valve 6. However, the second perforated disk will not be damaged and will continue to serve the function. Alternatively, any of the alternative perforated discs 21, 22 or the perforated cone 23 may serve as the (first) perforated disc and/or second perforated disc.

Figure 5A:
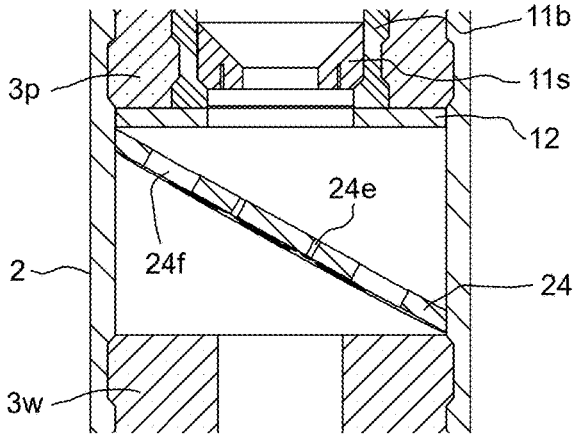
FIGS. 5A and 5B illustrate a third alternative perforated disc for use with the combination landing and float collar, according to another embodiment of the present disclosure.
Figure 5C:
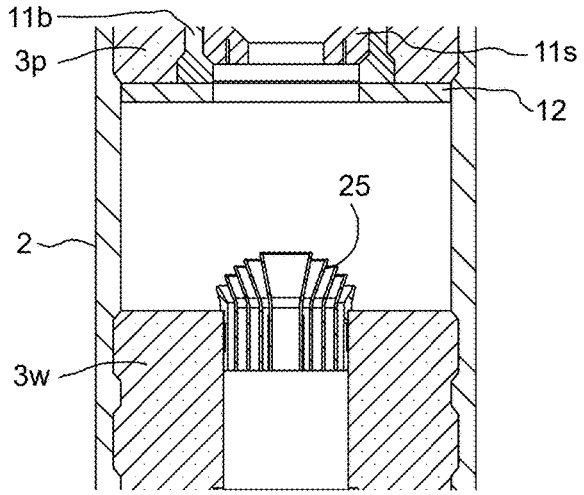
FIGS. 5C and 5D illustrate an alternative baffle for use with the combination landing and float collar, according to another embodiment of the present disclosure.
Figure 5D:
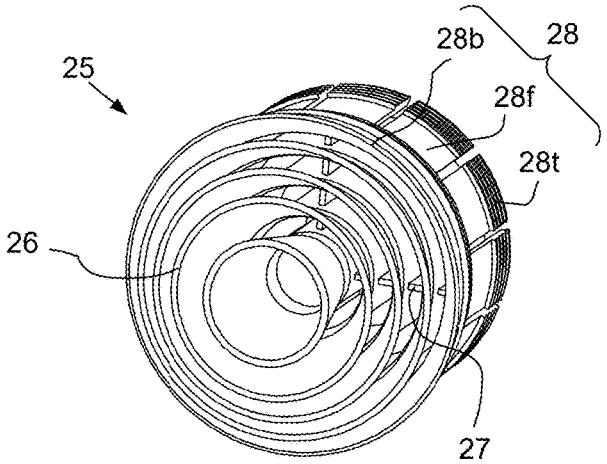
Figure 5B:
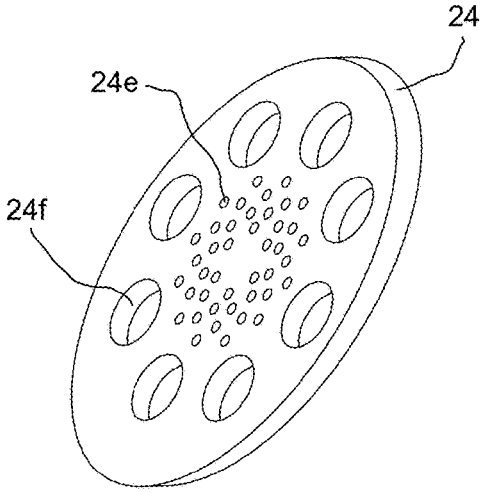

FIGS. 5A and 5B illustrate a third alternative perforated disc 24 for use with the combination landing and float collar 1, according to another embodiment of the present disclosure. The third alternative perforated disc 24 may replace the baffle 5. The third alternative perforated disc 24 may be elliptical and have a major diameter greater than the inner diameter of the housing 2 such that the third alternative perforated disc can only be inserted into the chamber with an inclined orientation relative to the longitudinal axis of the housing 2, thereby, obviating the need for the spacers 5*p,w*. The third alternative perforated disc 24 may have one or more (four shown) arrays of equalization ports 24*e* located at an inner portion thereof and an array of flow ports 24*f* located at an outer portion thereof. Each array of ports 24*e,f* may be concentric with third alternative perforated disc 24. Each flow port 24*f* may be formed through the third alternative perforated disc 24 and have a diameter less than a diameter of the smaller setting ball 14*s* to prevent passage of the setting ball therethrough. Each equalization port 24*e* may be formed through the third alternative perforated disc 24 and have a diameter substantially less than a diameter of the flow ports 24*f*, such as less than one-half, one-third, or one-fourth thereof. Inclination of the third alternative perforated disc 24 may also cause the ports 24*e,f* to be angled (relative to an axis parallel to the longitudinal axis of the housing 2) by a corresponding amount.

FIGS. 5C and 5D illustrate an alternative baffle 25 for use with the combination landing and float collar 1, according to another embodiment of the present disclosure. The alternative baffle 25 may replace the baffle 5. The alternative baffle 25 may be made from any of the materials of the body 15, discussed above. The alternative baffle 25 may include an inner cluster 26 of tubes, a plurality of brackets 27, and an outer anchor 28.

The cluster 26 may include a central inner tube, an outer tube, and a plurality of intermediate tubes. The tubes of the cluster 26 may be concentrically nested and each tube may be mounted to one or more adjacent tubes and/or the anchor 28 by one or more of the brackets 27. The central tube may have a bore formed therethrough and an annulus may be formed between the central tube and the adjacent intermediate tube, between adjacent pairs of adjacent intermediate tubes, and between the outer tube and the anchor 28. Each tube of the cluster 26 may have a frusto-conical upper portion and a cylindrical lower portion. Each upper portion may flare outwardly away from the cylindrical lower portion. The central tube may have a maximum diameter less than a diameter of the smaller setting ball 14*s* to prevent passage of the setting ball therethrough. The annuli between the tubes of the cluster 26 may have a maximum radial gap less than a diameter of the smaller setting ball 14*s* to prevent passage of the setting ball therethrough. The central tube may have a length greater than a length of the adjacent intermediate tube, each inner one of a pair of adjacent intermediate tubes may have a length greater than the outer one of the pair, and the outer tube may have a length greater than a length of the anchor 28 such that a profile of the top of the alternative baffle 25 is frusto-conical to deflect the balls 14*r,s* from seating thereon. Each bracket 27 may be secured to the respective tubes of the cluster 26 and the anchor 28, such as by adhesive.

The anchor 28 may include an annular base 28*b* and a plurality of split fingers 28*f* extending longitudinally from the base. An upper portion of the base 28*b* may have an outer diameter that is greater than a diameter of the bore of the lower sheath 3*w* at the top thereof and a lower portion of the base may have an outer diameter that is less than a diameter of the bore of the lower sheath and the base may have a shoulder formed between the upper and lower portions. The shoulder of the base 28*b* may seat against the top of the lower sheath 3*w* to prevent the alternative baffle 25 from being driven down the bore of the lower sheath.

A lower portion of each finger 28*f* may have a plurality of circumferential teeth 28*t* (aka wickers) formed on an outer surface thereof. Each tooth 28*t* may have a cross sectional shape resembling a right triangle and the hypotenuses of the teeth of may incline toward the base 28*b*, thereby providing unidirectional gripping of the lower sheath 3*w* adjacent the bore thereof. The fingers 28*f* may be cantilevered from the base 28*b* and have a stiffness biasing the fingers toward a natural position where the teeth 28*t* have a major diameter greater than or equal to a diameter of the bore of the lower sheath 3*w*. Driving of the anchor 28 down the bore of the lower sheath 3*w* may radially compress the fingers 28*f* to a retracted position where the stiffness of the fingers exerts a setting force engaging the teeth 28*t* with an inner surface of the lower sheath 3*w*. Engagement of the teeth 28*t* with the lower sheath 3*w* may then mount the alternative baffle 25 to the lower sheath to prevent any upward force from removing the alternative baffle 25 from the bore thereof.

Alternatively, the anchor 28 may only have a single split finger (C-ring) instead of a plurality of split fingers 28*f*.

The base 28*b* may also have a plurality of circumferential teeth formed on an outer surface thereof. The base teeth may be similar to the finger teeth 28*t* in shape and orientation. The base teeth may have a fixed major diameter equal to or slightly greater than the diameter of the bore of the lower sheath 3*w*. The base teeth may be wedged into engagement with the inner surface of the lower sheath 3*w* adjacent the bore thereof while driving the anchor 28 into the bore just before engagement of the shoulder of the base 28*b* with the top of the sheath 3.

An installation tool (not shown) may be used to insert of the alternative baffle 25 into the bore of the lower sheath 3*w*. The installation tool may include an adapter and a shaft. The adapter may have a lower annular portion for receiving the base 28*b* and an upper conical portion for receiving the cluster 26. The shaft may extend from the adapter for a length sufficient to protrude from a top of the housing 2. The alternative baffle 25 may be temporarily secured to the adapter, such as using reusable adhesive putty or tape. The alternative baffle 25 may then be lowered into the housing bore by the shaft until the anchor 28 reaches the bore of the lower sheath 3*w*. The anchor 28 may be aligned with the lower sheath bore and the installation tool may be set down. A setting force may then be exerted on the installation tool either manually or using a hammer, thereby driving the anchor 28 into the lower sheath bore. The setting force may continue to be applied until the shoulder of the base 28*b* seats against the top of the lower sheath. A removal force may then be exerted on the installation tool to release the alternative baffle 25 therefrom and the installation tool may be removed from the housing 2.

Advantageously, the alternative baffle 25 may also serve as a fluid surge protector for the float valve 6 and/or lower sheath 3*w* but in a different fashion than the alternative perforated disc 21. Instead of creating a tortuous flow path, the alternative baffle 25 may operate as a flow straightener to convert turbulent flow of the fluid surge into laminar flow through the bore of the lower sheath and the float valve 6.

Figure 5E:
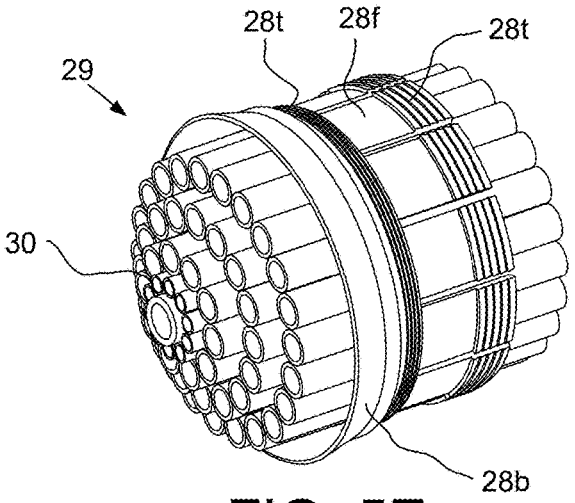
FIG. 5E illustrates a second alternative baffle for use with the combination landing and float collar, according to another embodiment of the present disclosure.

FIG. 5E illustrates a second alternative baffle 29 for use with the combination landing and float collar 1, according to another embodiment of the present disclosure. The second alternative baffle 29 may replace the baffle 5. The second alternative baffle 29 may be made from any of the materials of the body 15, discussed above. The second alternative baffle 29 may include an inner cluster 30 of tube arrays, the brackets 27, and the outer anchor 28.

The cluster 30 may include a central inner tube, an outer array of tubes, and a plurality of intermediate arrays of tubes. Each array of tubes may include a plurality of tubes connected together in a cylindrical array, such as by adhesive. The central tube may have a bore formed therethrough and an annulus may be formed between the central tube and the adjacent intermediate array of tubes, between adjacent pairs of adjacent intermediate arrays of tubes, and between the outer array of tubes and the anchor 28. The central tube and the tubes of the arrays may each have a diameter less than a diameter of the smaller setting ball 14*s* to prevent passage of the setting ball therethrough. The annuli between the arrays of tubes of the cluster 30 (and between the central tube and the adjacent array of tubes) may have a radial gap less than a diameter of the smaller setting ball 14*s* to prevent passage of the setting ball therethrough. The central tube may have a length greater than a length of the adjacent intermediate array of tubes, each inner one of a pair of adjacent intermediate arrays of tubes may have a length greater than the outer one of the pair, and the outer array of tubes may have a length greater than a length of the anchor 28 such that a profile of the top of the second alternative baffle 29 is frusto-conical to deflect the balls 14*r,s* from seating thereon. Each bracket 27 may be secured to the respective central tube and arrays of tubes of the cluster 30 and the anchor 28, such as by adhesive.

Figure 6A:
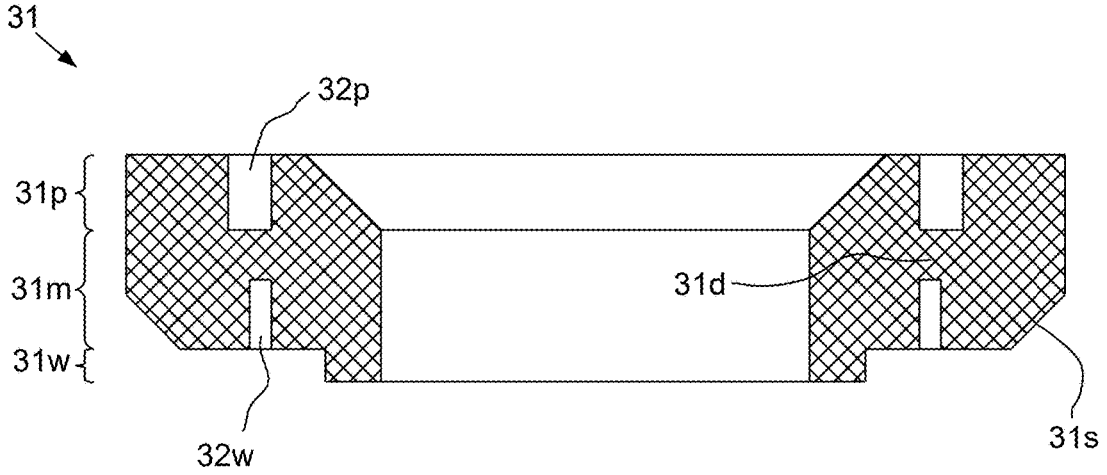
FIGS. 6A-6C illustrate the seat of an alternative ball receptacle, according to another embodiment of the present disclosure.
Figure 6B:
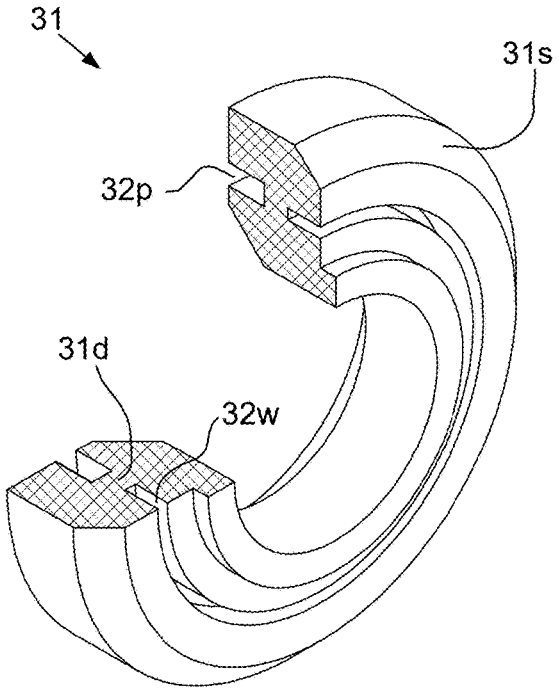
Figure 6C:
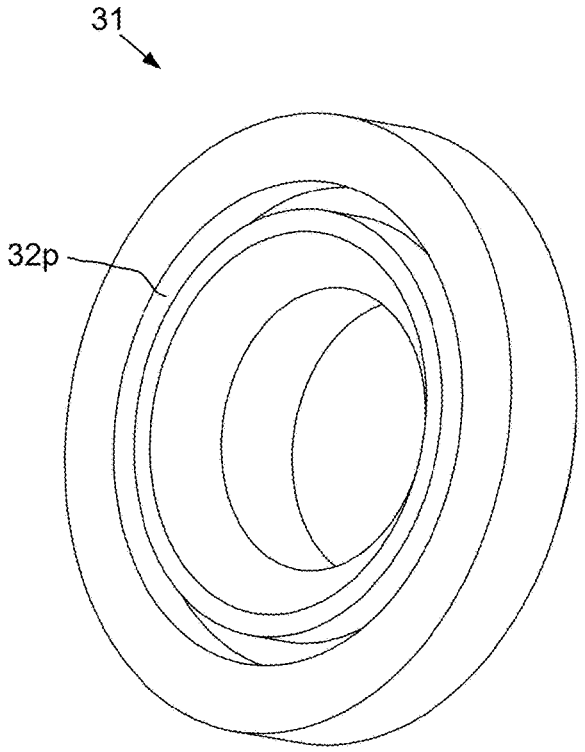

FIGS. 6A-6C illustrate the seat 31 of an alternative ball receptacle, according to another embodiment of the present disclosure. The seat 31 may replace the seat 11*s* such that the alternative ball receptacle includes the outer body 11*b* and the inner seat 31.

The seat 31 may be annular, have a flow bore formed therethrough, and have a maximum outer diameter slightly greater than the enlarged inner diameter of the outer body 11*b*, thereby forming a press fit there-between. The seat 31 may be made from a composite material, such as a fiber reinforced polymer, such as having a thermoplastic or thermoset matrix reinforced by ceramic or carbon fibers, such as glass fibers. The seat 31 may be of one-piece construction. The seat 31 may have an upper portion 31*p* with a non-cylindrical, such as a frusto-conical, inner surface, for receiving the setting ball 14*s*, a cylindrical mid portion 31*m*, and a cylindrical lower portion 31*w* having a reduced outer diameter (relative to the other portions thereof).

The seat 31 may be disposed within the outer body 11*b* and may have a shoulder 31*s* of the mid portion 31*m* formed at an interface between the outer surface and bottom thereof for engaging the shoulder of the outer body. The shoulders of the alternative ball receptacle may be tapered. A taper angle of the seat shoulder 31*s* may correspond with a taper angle of the outer body shoulder such that tapered fit is formed there-between. The tapered fit may be self-holding or self-releasing. The press fit and the tapered fit between the seat shoulder 31*s* and the body shoulder may longitudinally and torsionally connecting seat 31 and the outer body 11*b*.

The press fit and/or the tapered fit between the seat shoulder 31*s* and body shoulder may also seal an interface between the seat 11*s* and the outer body 11*b*. The upper portion 31*p* of the seat 31 may have an inner diameter decreasing from an upper end thereof to an interface with the mid portion 31*m* of the seat. The mid 31*m* and lower 31*w* portions of the seat 31 may have a constant inner diameter.

Alternatively, the seat 31 may be bonded to the body 11*b* using an adhesive instead of being press fit.

The upper portion 31*p* of the seat may be pre-weakened by an upper annular recess 32*p* extending longitudinally from a top thereof, into a wall thereof, and terminating near the interface between the upper portion and the mid portion 31*m* of the seat 31. The upper annular recess 32*p* may be blind, such as having a length ranging between one-quarter and one-half the length of the seat 31. The mid portion 31*m* of the seat may be pre-weakened by a lower annular recess 32*w* extending longitudinally from a bottom thereof, into a wall thereof, and having a length ranging between one-quarter and one-half the length of the seat 31. The lower recess 32*w* may also be blind. The recesses 32*p,w* may be roughly aligned, such as having the same inner diameters, and may have different widths, such as the upper recess 32*p* having a width greater than the width of the lower recess 32*w* by a ratio of greater than or equal to one point five. A solid portion 31*d* of the wall of the mid-portion 31*m* formed between the recesses 32*p,w* may remain for structural integrity of the seat 31. The solid portion 31*d* may have a length ranging between ten and forty percent of the length of the seat 31.

Figure 7A:
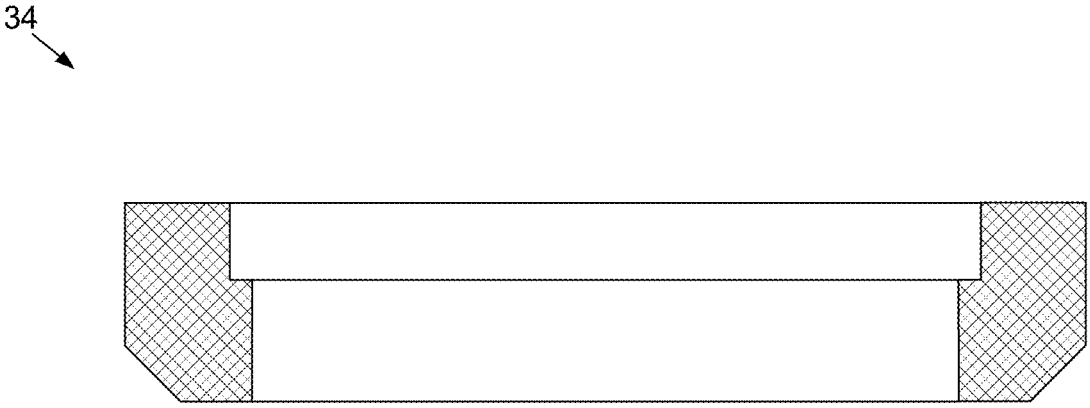
FIGS. 7A and 7B illustrate operation of the alternative ball receptacle.
Figure 7B:
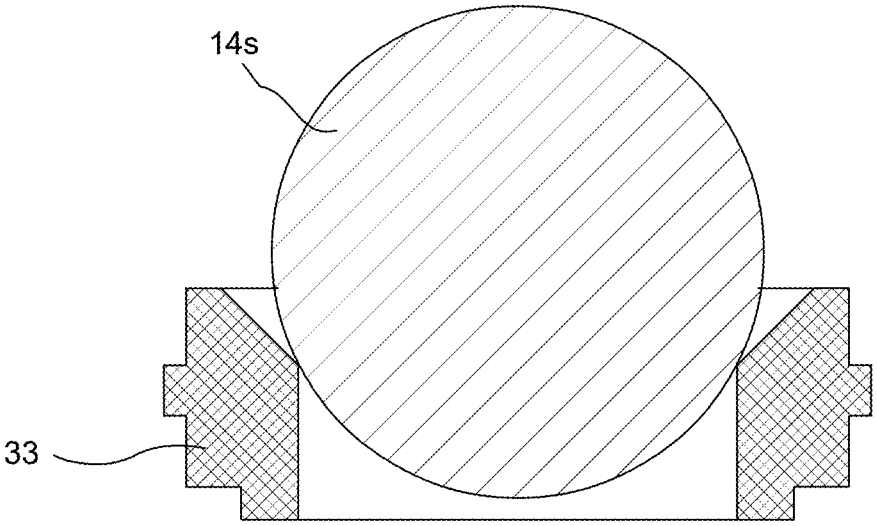

FIGS. 7A and 7B illustrate operation of the alternative ball receptacle. The seat 31 may be operable to receive and hold the setting ball 14*s*, keep the setting ball until the threshold pressure has been reached, and then release the setting ball. Due to the pre-weakening of the seat 31 by the recesses 32*p,w*, the solid portion 31*d* may fracture, such as by shearing, from a force exerted thereon by the threshold pressure exerted on the setting ball 14*s*, thereby releasing an inner fragment 33 of the seat 31 from a remaining outer portion 34 thereof and releasing the setting ball from the seat. Ejection of the inner fragment 33 from the remining outer portion 34 of the seat 31 may also increase a minimum diameter of the remaining outer portion such that a second larger ball, such as releasing ball 14*r*, may pass therethrough unobstructed. The lower portion 31*w* may serve a standoff when the inner fragment 33 seats onto the perforated disc 5*d*.

In another aspect of the disclosure, specifically referring to first paragraph of the Summary of the Disclosure Section, a length of the housing is less than or equal to ten feet (three meters). In another aspect of the disclosure, specifically referring to first paragraph of the Summary of the Disclosure Section, the housing further has a second coupling formed at another longitudinal end thereof for assembly as part of a downhole tubular, and the float valve, the receiver, the first and second sheaths, and the baffle are made from materials drillable by a polycrystalline diamond compact (PDC) drill bit.

In another aspect of the disclosure, specifically referring to second paragraph of the Summary of the Disclosure Section, the blind annular recess extends from a lower end surface thereof, and the seat further has a second blind annular recess extending from an upper end surface thereof. In another aspect of the disclosure, specifically referring to second paragraph of the Summary of the Disclosure Section, the seat is made from a composite material. In another aspect of the disclosure, specifically referring to second paragraph of the Summary of the Disclosure Section, the ball is a first ball, the seat is operable to pass a second ball therethrough after fracturing of the inner fragment from the outer portion, and the second ball is larger than the first ball. In another aspect of the disclosure, specifically referring to second paragraph of the Summary of the Disclosure Section, the receptacle further includes: a tubular housing having a coupling formed at a longitudinal end thereof for assembly as part of a downhole tubular; a plug seat; and a sheath bonding the plug seat and the body to an inner surface of the housing within a flow bore thereof. In another aspect of the disclosure, specifically referring to second paragraph of the Summary of the Disclosure Section, the body has a shoulder formed in an inner surface thereof, the seat further has a shoulder engaged with the shoulder of the body, and the seat is press fit within the body.

While the foregoing is directed to embodiments of the present disclosure, other and further embodiments of the disclosure may be devised without departing from the basic scope thereof, and the scope of the invention is determined by the claims that follow.

The invention claimed is:

1. A combination landing and float collar for use in a wellbore, comprising:
- a float valve;
- a receiver comprising a plug seat and a ball seat;
- a tubular housing having a coupling formed at a longitudinal end thereof for assembly as part of a downhole tubular;
- a first sheath bonding the receiver to an inner surface of the housing within a flow bore thereof;
- a second sheath bonding the float valve to the inner surface of the housing within the flow bore thereof;
- a chamber formed in the housing between the first and second sheaths and operable to keep a ball released from the ball seat; and
- a baffle disposed in the chamber and operable to prevent passage of the ball therethrough, wherein:
- the first sheath is an upper sheath and the second sheath is a lower sheath,
- the collar further comprises a wiper plug having a core and a wiper seal molded on to the core,
- a top of the upper sheath has a tapered inner surface,
- a bottom of the wiper seal is tapered, and
- a tapered fit is formed between the upper sheath and the wiper seal upon landing of the wiper plug on to the plug seat.

2. The collar of claim 1, wherein the baffle comprises a perforated disc.

3. The collar of claim 2, wherein:
- the perforated disc is elliptical,
- the perforated disc has a major diameter greater than an inner diameter of the housing, and
- the perforated disc is disposed in the chamber at an inclined orientation.

4. The collar of claim 1, wherein the baffle comprises a perforated cone.

5. The collar of claim 1, wherein:
- the baffle comprises an inner cluster of tubes and an outer anchor engaged with an inner surface of the lower sheath adjacent to a bore of the lower sheath.

6. The collar of claim 5, wherein the cluster comprises a central inner tube, an outer tube, and an intermediate tube.

7. The collar of claim 5, wherein the cluster comprises a central inner tube, an outer array of tubes, and an intermediate array of tubes.

8. The collar of claim 5, wherein:
the anchor has an annular base and a split finger extending longitudinally from the base,
a lower portion of the finger has a plurality of circumferential teeth formed on an outer surface thereof,
the finger is biased toward a natural position, and
the teeth are engaged with the inner surface of the lower sheath with the finger in a retracted position.

9. The collar of claim 1, wherein:
the baffle has small flow ports formed through an inner portion thereof and large flow ports formed through an outer portion thereof, and
each small flow port and each large flow port are tilted relative to a longitudinal axis of the housing.

10. The collar of claim 1, wherein:
an inner fragment of the ball seat is operable to fracture from an outer portion of the ball seat in response to a threshold pressure exerted on the ball seated therein, thereby releasing the ball, and
the chamber is further operable to keep the inner fragment.

11. The collar of claim 10, wherein:
the ball is a first ball,
the ball seat is operable to pass a second ball therethrough after fracturing of the inner fragment from the outer portion,
the second ball is larger than the first ball, and
the chamber is further operable to keep the second ball.

12. The collar of claim 1, wherein:
the core has a nose protruding therefrom,
an anti-rotation profile is formed in a tip of the nose,
the plug seat has a socket formed in an inner surface thereof,
an anti-rotation profile is formed in the socket, and
engagement of the nose with the socket torsionally connects the wiper plug and the plug seat.

13. The collar of claim 1, wherein:
the float valve, comprises:
a body bonded to the lower sheath;
a poppet movable relative to the body between an open position and a closed position; and
a spring biasing the poppet toward the closed position.

14. The collar of claim 1, wherein a length of the housing is less than or equal to ten feet (three meters).

15. The collar of claim 1, wherein:
the housing further has a second coupling formed at another longitudinal end thereof for assembly as part of a downhole tubular, and
the float valve, the receiver, the first and second sheaths, and the baffle are made from materials drillable by a polycrystalline diamond compact (PDC) drill bit.

16. A combination landing and float collar for use in a wellbore, comprising:
a float valve;
a receiver comprising a plug seat and a ball seat;
a tubular housing having a coupling formed at a longitudinal end thereof for assembly as part of a downhole tubular;
a first sheath bonding the receiver to an inner surface of the housing within a flow bore thereof;
a second sheath bonding the float valve to the inner surface of the housing within the flow bore thereof;
a chamber formed in the housing between the first and second sheaths and operable to keep a ball released from the ball seat; and
a baffle disposed in the chamber and operable to prevent passage of the ball therethrough,
wherein:
the baffle has equalization ports formed through an inner portion thereof and flow ports formed through an outer portion thereof for creating a tortuous flow path from the chamber to the second sheath, and
each equalization port has a diameter less than one-half of a diameter of the flow ports.

17. A combination landing and float collar for use in a wellbore, comprising:
a float valve;
a receiver comprising a plug seat and a ball seat;
a tubular housing having a coupling formed at a longitudinal end thereof for assembly as part of a downhole tubular;
a first sheath bonding the receiver to an inner surface of the housing within a flow bore thereof;
a second sheath bonding the float valve to the inner surface of the housing within the flow bore thereof;
a chamber formed in the housing between the first and second sheaths and operable to keep a ball released from the ball seat; and
a baffle disposed in the chamber and operable to prevent passage of the ball therethrough,
wherein:
the receiver comprises a tubular body; and
the ball seat is an annular seat:
disposed within the body,
connected to the body,
made of one-piece construction,
having an upper portion with a non-cylindrical inner surface for receiving the ball, and
having a blind annular recess extending from an end surface thereof such that an inner fragment of the seat is operable to fracture from an outer portion of the seat in response to a threshold pressure exerted on the ball seated therein, thereby releasing the ball.

18. The collar of claim 17, wherein:
the blind annular recess extends from a lower end surface thereof, and
the ball seat further has a second blind annular recess extending from an upper end surface thereof.

19. The collar of claim 17, wherein the ball seat is made from a composite material.

* * * * *